US006471293B2

(12) United States Patent
Ware et al.

(10) Patent No.: US 6,471,293 B2
(45) Date of Patent: Oct. 29, 2002

(54) STACKABLE CHAIR WITH FLEXIBLE BACK SUPPORT

(75) Inventors: R. Duane Ware, Temperance, MI (US); William F. Lohness, Jonesville, MI (US)

(73) Assignee: Michigan Tube Swagers & Fabricators, Inc., Temperance, MI (US)

( * ) Notice: Subject to any disclaimer, the term of this patent is extended or adjusted under 35 U.S.C. 154(b) by 0 days.

(21) Appl. No.: 09/801,987

(22) Filed: Mar. 8, 2001

(65) Prior Publication Data

US 2002/0053822 A1 May 9, 2002

Related U.S. Application Data

(60) Provisional application No. 60/247,524, filed on Nov. 9, 2000.

(51) Int. Cl.[7] ..... A47C 3/04; A47C 1/024

(52) U.S. Cl. ..... 297/239; 297/301.1; 297/354.1; 297/285; 297/452.2

(58) Field of Search ..... 297/239, 285, 297/301.1, 354.1, 452.18, 452.2

(56) References Cited

U.S. PATENT DOCUMENTS

| | | | | |
|---|---|---|---|---|
| 2,063,781 A | | 12/1936 | Ball | |
| 2,587,822 A | * | 3/1952 | Corning | 297/301.1 X |
| 2,745,468 A | | 5/1956 | Kramer | |
| 2,802,514 A | | 8/1957 | Ninde | |
| 2,987,112 A | | 6/1961 | Dorton | |
| 3,544,160 A | * | 12/1970 | Karasick | 297/354.1 |
| 3,788,586 A | | 1/1974 | McNally | |
| 3,973,798 A | | 8/1976 | White | |
| 3,982,785 A | | 9/1976 | Ambasz | |
| 4,032,190 A | | 6/1977 | Muller-Deisig et al. | |
| 4,084,850 A | * | 4/1978 | Ambasz | 297/301.1 X |
| 4,235,408 A | | 11/1980 | Sapper | |
| 4,333,683 A | * | 6/1982 | Ambasz | 297/301.1 X |
| 4,431,157 A | | 2/1984 | Arild | |

(List continued on next page.)

FOREIGN PATENT DOCUMENTS

| | | | | |
|---|---|---|---|---|
| AT | 89393 | * | 9/1922 | 297/301.1 |
| DE | 415483 | * | 6/1925 | 297/301.1 |
| IT | 257871 | * | 3/1928 | 297/301.1 |

*Primary Examiner*—Rodney B. White
(74) *Attorney, Agent, or Firm*—Gifford, Krass, Groh, Sprinkle, Anderson & Citkowski, P.C.

(57) ABSTRACT

A stackable chair includes a base with a pair of inverted U-shaped leg members. Each of the leg members includes a front leg portion, a rear leg portion, and a generally horizontal portion interconnecting the front and rear leg portions. The base also has a generally horizontal seat cushion frame extending between the U-shaped leg members with the transverse front spring reinforcement bar extending side-to-side. A back support frame has a generally vertical portion with an upper and lower end and a generally horizontal portion that extends from the lower end. The generally horizontal portion includes a transverse rear spring reinforcement bar. A spring member has one end interconnected with the front spring reinforcement bar and another end interconnected with the rear spring reinforcement bar. The spring member supports the back support frame such that the back support frame has an unstressed position and a reclined position. In the unstressed position, the generally horizontal portion of the back support frame is generally co-planar with the seat cushion frame. In the recline position, the generally vertical portion of the back support frame is moved rearwardly, and the generally horizontal portion of the back support frame is moved downwardly. The spring member biases the back support frame into the unstressed position. A seat cushion is supported by the seat cushion frame and the generally horizontal portion of the back support frame.

25 Claims, 4 Drawing Sheets

U.S. PATENT DOCUMENTS 4,549,764 A 10/1985 Haedo
4,580,836 A 4/1986 Verney
4,585,272 A 4/1986 Ballarini
4,597,567 A 7/1986 Racca
4,603,830 A 8/1986 Franck
4,603,904 A 8/1986 Tolleson et al.
4,633,546 A 1/1987 Bergs
4,666,121 A 5/1987 Choong et al.
4,790,595 A 12/1988 Hensel et al.
4,869,552 A 9/1989 Tolleson et al.
4,877,290 A 10/1989 Schetl
4,889,385 A 12/1989 Chadwick et al.
4,892,354 A 1/1990 Estkowski et al.
4,911,501 A 3/1990 Decker et al.
4,938,532 A 7/1990 Burgess
4,943,114 A 7/1990 Piretti
5,018,787 A 5/1991 Estkowski et al.
5,024,484 A 6/1991 Buchacz
5,024,485 A 6/1991 Berg et al.
5,039,163 A 8/1991 Tolleson
5,044,587 A 9/1991 Degen
5,048,893 A 9/1991 Cowan et al.
5,062,676 A 11/1991 Mars
5,100,201 A 3/1992 Becker, III et al.
5,114,210 A 5/1992 Naess
5,123,702 A 6/1992 Caruso
5,154,472 A 10/1992 Kaufman
5,193,880 A 3/1993 Keusch et al.
5,203,853 A 4/1993 Caruso
5,261,727 A 11/1993 Klaebel
5,288,127 A 2/1994 Berg et al.
5,320,410 A 6/1994 Faiks et al.
5,501,507 A 3/1996 Hummitzsch
5,580,127 A 12/1996 Piretti
5,681,085 A 10/1997 Nahoul
5,697,673 A 12/1997 Favaretto
5,704,688 A 1/1998 Schrewe et al.
5,868,468 A 2/1999 Wang
5,871,256 A 2/1999 Kogai
5,887,945 A 3/1999 Sedlack
5,890,763 A 4/1999 Asbjornsen
5,902,012 A 5/1999 Han
5,904,397 A 5/1999 Fismen
5,931,531 A 8/1999 Assmann
5,997,084 A 12/1999 Barile, Jr. et al.
6,000,755 A 12/1999 Uhlenbrock
6,019,429 A 2/2000 Tedesco
6,033,021 A 3/2000 Udo et al.
6,050,642 A 4/2000 Erb
6,065,803 A 5/2000 Li et al.
6,099,076 A 8/2000 Nagel et al.

* cited by examiner 46
48
44
10
66
60
64
40
18
68
34
54
36
62
69
50
69
38
16
26
12
22
20

STACKABLE CHAIR WITH FLEXIBLE BACK SUPPORT

REFERENCE TO RELATED APPLICATION

This application claims priority from U.S. provisional application Serial No. 60/247,524, filed Nov. 9, 2000, the entire contents of which are incorporated herein by reference.

FIELD OF THE INVENTION

The present invention relates generally to chairs which may be stacked one atop another for storage and, more specifically, to a stackable chair with a back portion that flexes to improve the comfort of an occupant.

BACKGROUND OF THE INVENTION

Stackable banquet chairs are well known in the prior art. They typically are designed to stack one atop another when not in use so as to reduce the necessary storage space. The chairs may have a padded seat cushion and a padded back support cushion. The back support is at an angle to the seat cushion and usually is essentially non-flexible.

Numerous attempts have been made to improve the comfort level of occupants using stackable banquet chairs. For example, there have been various attempts at providing stackable chairs with flexible backs. That is, there have been designs that allow the back support portion of the chair to flex with respect to the seat cushion, thereby allowing an occupant to slightly recline.

SUMMARY OF THE INVENTION

The present invention provides an improved stacking chair with a flexible back support. According to one preferred embodiment, the stackable chair has a base with a pair of inverted U-shaped leg members that each include a front leg portion, a rear leg portion, and a generally horizontal portion interconnecting the front and rear leg portions. The base also includes a generally horizontal seat cushion frame that extends between the U-shaped leg members and has a transverse front spring reinforcement bar extending side-to-side. A back support frame has a generally vertical portion with a upper and lower end, and a generally horizontal portion extending from the lower end. The generally horizontal portion includes a transverse rear spring reinforcement. A spring member has one interconnected with a front spring reinforcement bar, and another end interconnected with the rear spring reinforcement bar. The spring member supports the back support frame such that the back support frame has an unstressed position wherein the generally horizontal portion of the back support frame is generally co-planar with the seat cushion frame. The back support frame also has a reclined position, wherein the generally vertical portion of the back support frame is moved rearwardly and the generally horizontal portion of the back support frame is moved downwardly. The spring member biases the back support frame into the unstressed position. The seat cushion frame and the generally horizontal portion of the back support frame cooperate to support a seat cushion in a generally horizontal position.

DETAILED DESCRIPTION OF THE PREFERRED EMBODIMENTS

Figure 1:
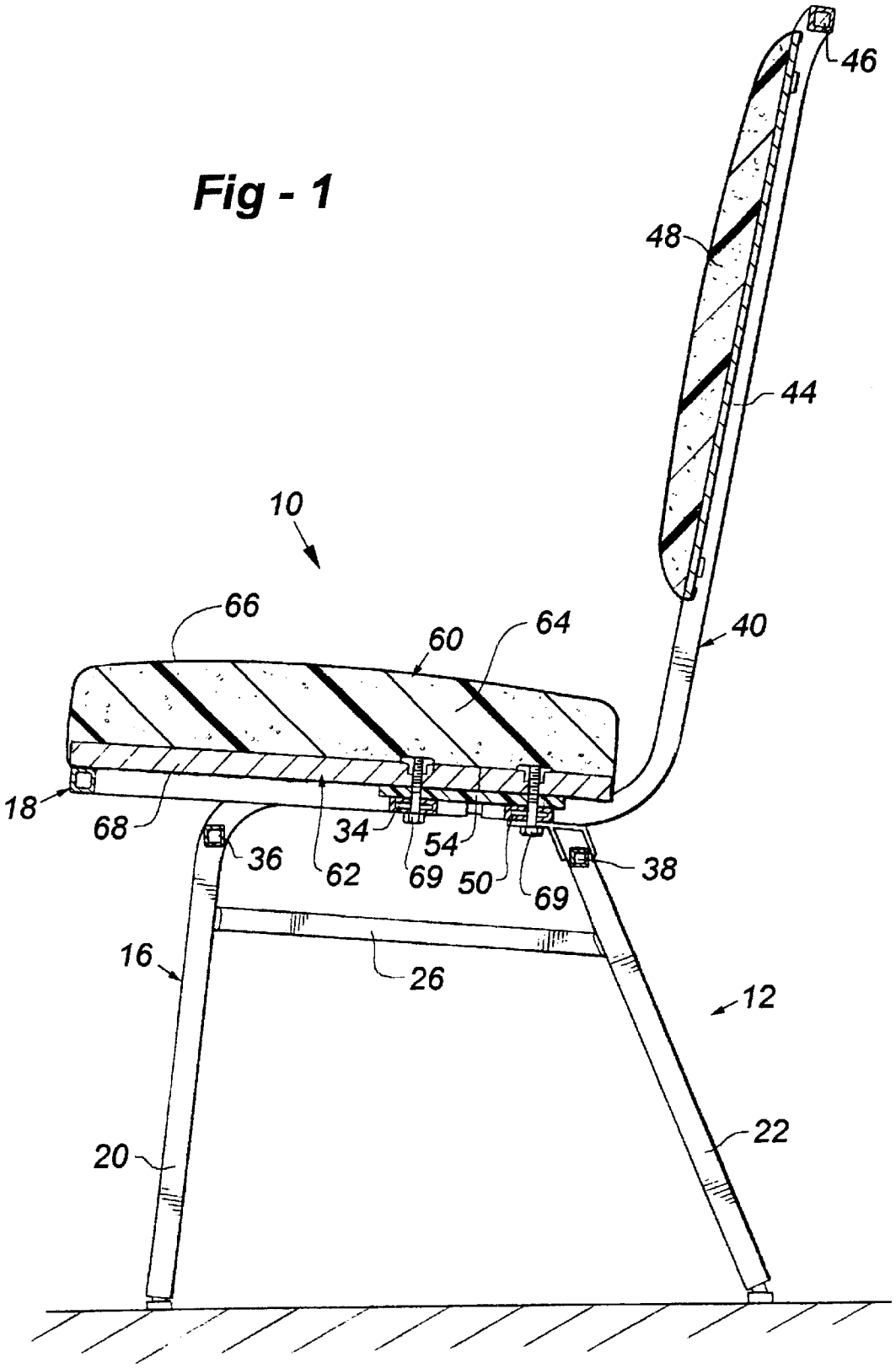
FIG. 1 is a cross-sectional side elevational view of a stackable chair according to the present invention.
Figure 2:
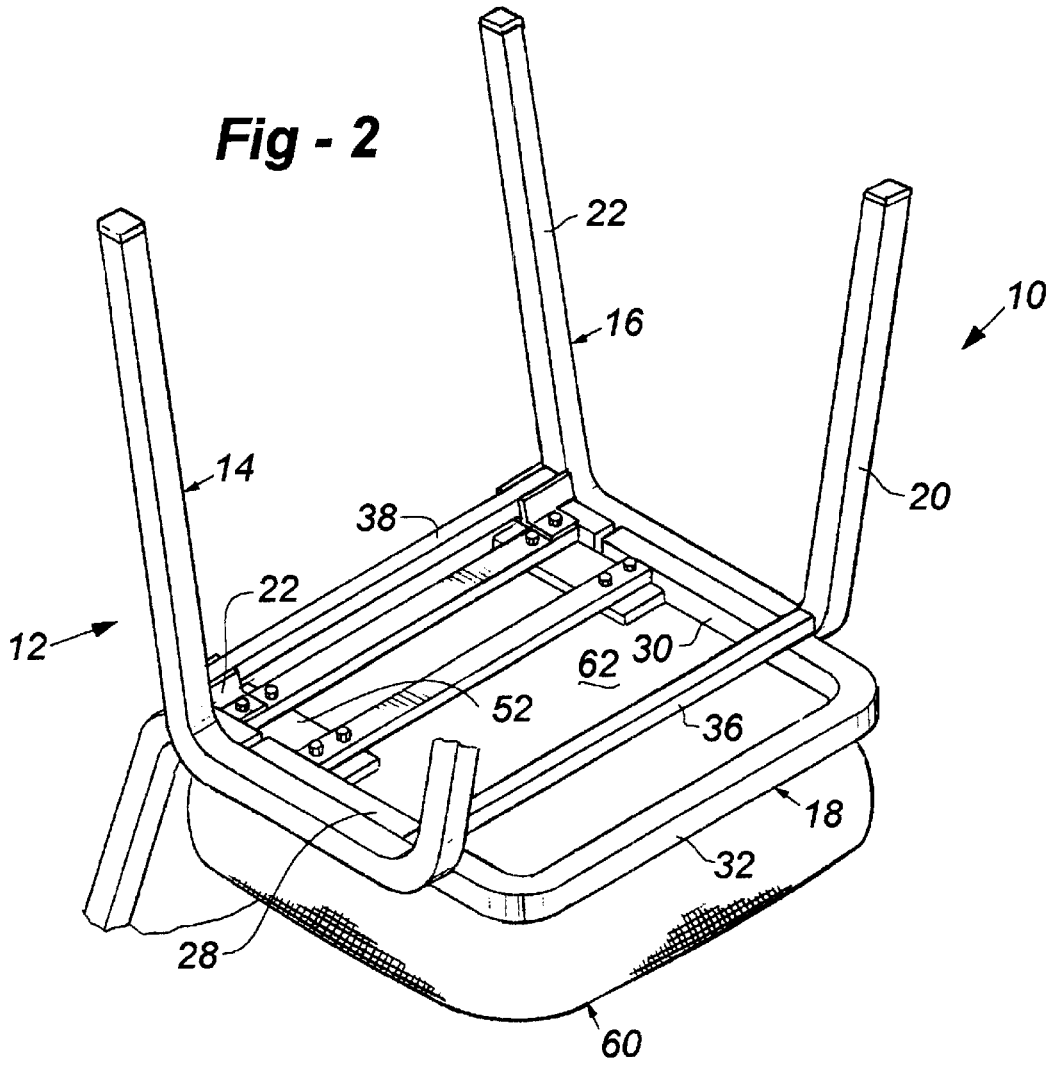
FIG. 2 is a bottom perspective view of a stackable chair according to the present invention showing the flex mechanism.
Figure 4:
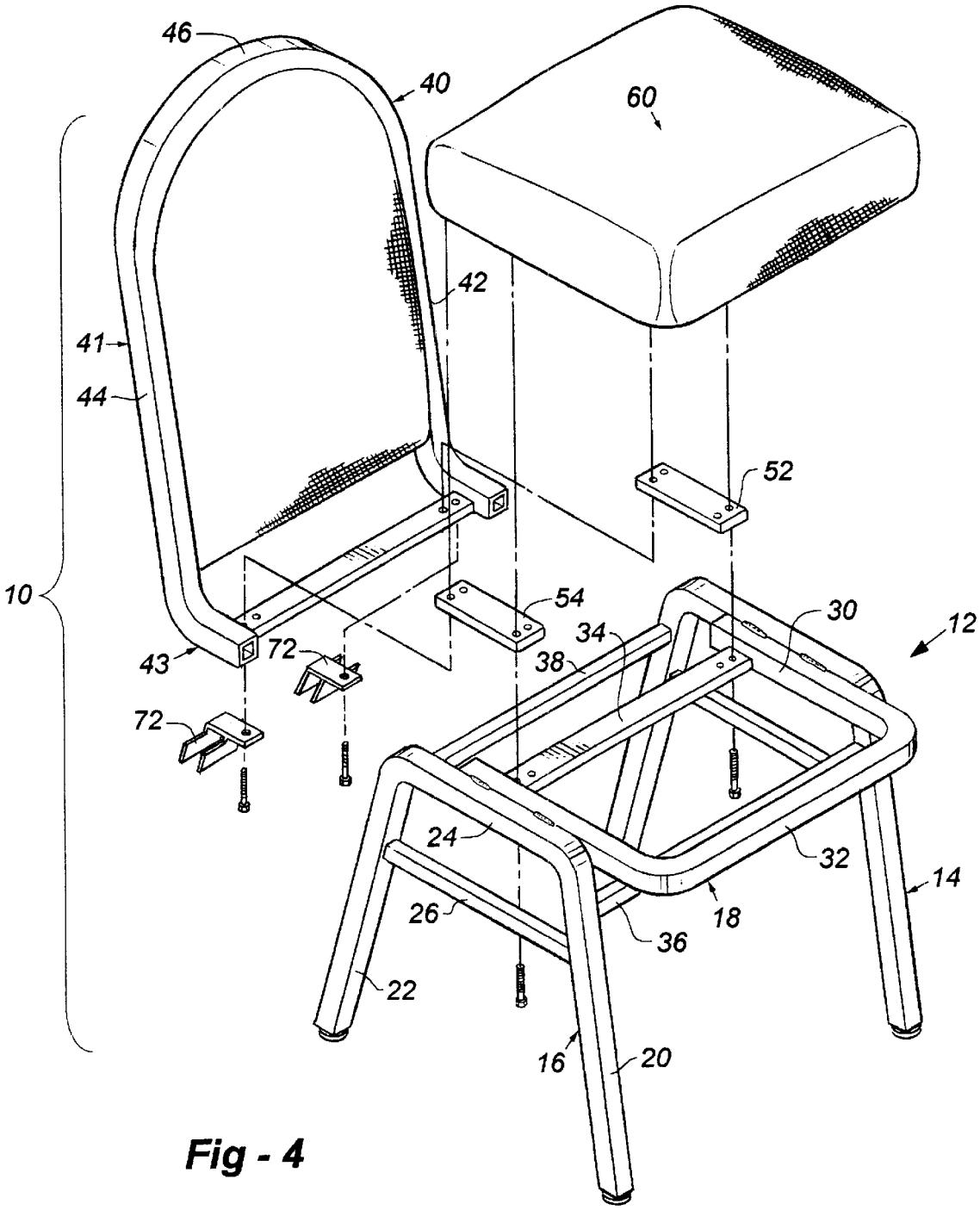
FIG. 4 is an exploded perspective view of a chair according to the present invention.

Referring to FIGS. 1, 2 and 4, a stackable chair with a flexible back support according to the present invention is generally shown at 10. The chair includes a base 12 including four legs and a seat cushion support frame. As will be clear to those of skill in the art, the design of the base allows multiple chairs to be stacked one on top of the other for storage purposes. This type of base includes a pair of inverted U-shaped leg members 14 and 16 that are interconnected by a generally horizontal seat cushion frame 18. As shown, the two inverted U-shaped leg members 14 and 16 are basically identical. Therefore, only leg member 16 will be described in more detail. Leg member 16 is a generally inverted U with the two legs of the U forming the front and back legs 20 and 22, respectively. The top of the inverted U is a generally horizontal portion 24 that interconnects the top ends of the front leg 20 and rear leg 22. The front 20 and rear 22 legs generally diverge as they extend downwardly from the generally horizontal portion 24. This allows chairs utilizing this frame design to be stacked one on top another with the upper part of the inverted U-shaped leg member of one chair nesting between the two diverging lower portions of the front and back legs of a chair stacked on top of the first chair.

In this illustrated embodiment, the U-shaped leg member 16 has a side reinforcement bar 26 (not shown in FIG. 2) that extends between the front leg 20 and rear leg 22 at a position spaced from the horizontal portion 24 and generally parallel to the horizontal portion 24. This bar creates a stiffer frame and also facilitates stacking. When stacked, the upper horizontal portion of one leg member rests against the underside of the side reinforcement bar 26 of the chair stacked atop it. The side reinforcement bar 26 is preferred, but not required.

The seat cushion frame 18 is generally C-shaped with a pair of side members 28 and 30 that are generally parallel with and welded to the upper horizontal portions of the leg members 14 and 16. The seat cushion frame 18 also includes a front member 32 that extends between the front ends of the side members 28 and 30. Though not illustrated, the front member 32 preferably has a dip in it so that a more shaped cushion can be used. In some typical stacking chairs, the side members 28 and 30 of the:seat cushion frame 18 can continue rearwardly and then curve upwardly so as to form the back support as well. However, as shown, in this embodiment, the side members 28 and 30 terminate short of the rear of the base 12. A transverse front spring reinforcement bar 34 extends side to side between the two side members 28 and 30 near the rearmost ends. In one embodiment, the front spring reinforcement bar 34 is generally rectangular tubing with a dimension of 1.5 inch×0.5 inch. The previously discussed leg and other members are preferably square tubular metal. In some stacking chairs, the seat cushion frame 18 forms the only interconnection between the leg members 14 and 16. In others, leg reinforcement bars extend side-to-side so as to interconnect the leg members more solidly. Because of the flexible back portion of this chair design, leg reinforcement bars are preferably provided. A generally horizontal front leg reinforcement bar 36 extends between the front left and front right legs close to their top ends. Likewise, a generally horizontal rear leg reinforcement bar 38 extends between the rear legs close to their top ends.

A back support frame 40 extends upwardly from the base so as to provide back support for a user sitting in the chair. The back support 40 is generally L-shaped in side view, as shown in FIG. 1. It has la perimeter frame including a pair of L-shaped side members 42 and 44 with the lower legs of each L being generally parallel to the seat cushion frame 18 and the upper legs of the L extending upwardly from the base to define the back supporting portion. The back support frame 40 also includes an interconnecting top portion 46 which may be shaped in various ways to provide different styles. A cushion 48 is supported by the perimeter frame for occupant comfort. A transverse rear spring reinforcement bar 50 extends side-to-side between the lower legs of the L-shaped side members 42 and 44 and is preferably also a rectangular tube like the front bar. The back support frame 40 may also be designed as having a generally vertical portion 41 with an upper end defined by the top portion 46 and a lower end defined at the bend in the side tubes, and a generally horizontal portion 43 which extends from the lower end of the generally vertical portion 41. By generally vertical, it is meant that the upwardly extending portion of the back support frame goes generally upwardly. However, as will be clear to those of skill in the art, the back of the chair is preferably tilted somewhat rearwardly for comfort purposes. Also, the generally horizontal seat cushion frame 18 and the generally horizontal portion 43 of the back support frame 40 may not be truly horizontal, but may instead be slanted for comfort purposes.

The back support frame 40 is interconnected with the base 12 by a pair of flat springs 52 and 54 which extend between the rear spring reinforcement bar 50 and the front spring reinforcement bar 34. Each spring 52 and 54 is preferably a piece of flexible resin and fiberglass composite spring material that allows some flexibility between the seat back frame 40 and frame 12 and exerts a restoring bias force such that the seat back is urged to its standard upright position, as shown in FIG. 1. Other springs may be used. When an occupant sits in the chair and leans back, the springs 52 and 54 flex allowing the seat back 40 to pivot backwardly.

Figure 3:
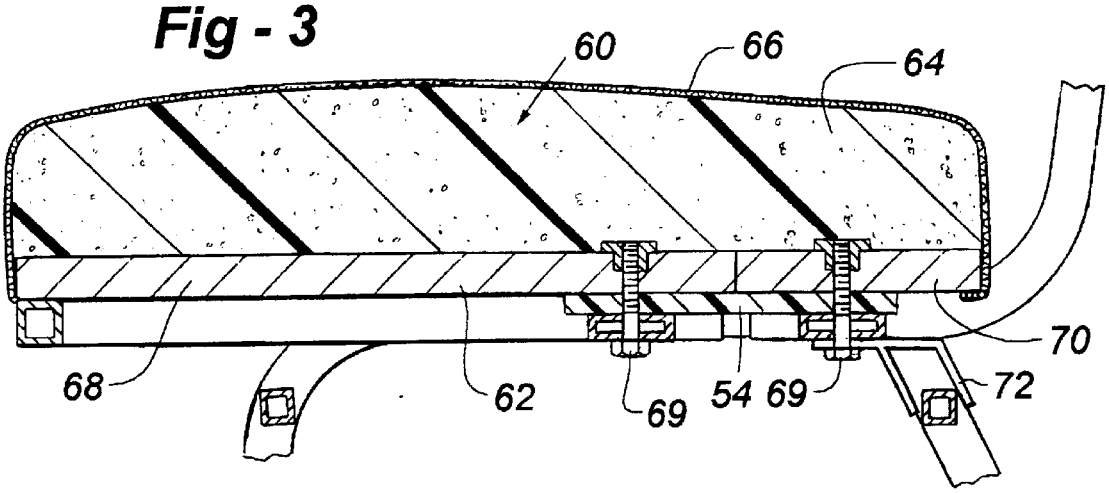
FIG. 3 is a detailed cross-sectional side view of a chair according to the present invention showing one preferred construction of a spring assembly and cushion.
Figure 5:
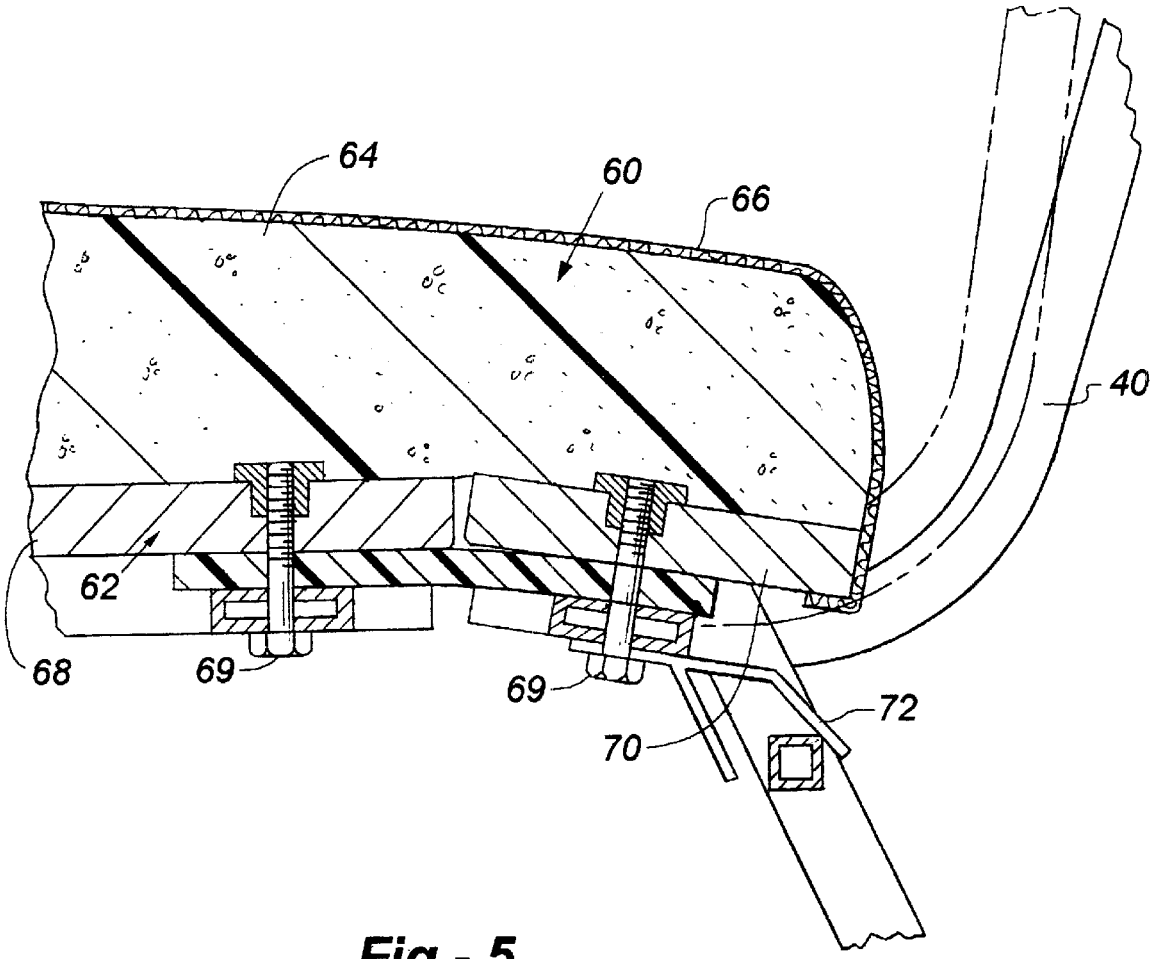
FIG. 5 is a detailed cross-sectional side view of a portion of a chair according to the present invention showing the chair in the reclined position.

A seat cushion 60 is provided for the occupant to sit on. The seat cushion includes a two-piece or split platform member 62 which may be a flat sheet of material such as wood and preferably may include webbing or other flexible materials to provide a ore comfortable seat. A cushion 64 with a fabric cover 66 is disposed on the platform ember 62. The platform member 62 has a front portion 68 and a rear portion 70 with a split therebetween. The back portion 70 is interconnected with the rear support reinforcement bar 50 while the front half is interconnected with the front spring reinforcement bar 34 and the remainder of the seat cushion frame 18. Preferably, bolts 69 interconnect the spring reinforcement bars, the springs, and the portions of the platform member as best illustrated in FIG. 3. During assembly, the springs 52 and 54 are preferably first interconnected with the cushion 60 and then the entire cushion assembly, with the springs, is interconnected with the base and back support frame. When the back support 40 is pivoted rearwardly, the rear portion 70 of the platform member 62 moves slightly backward and downward, thereby flexing the split between the front portion 68 and rear portion 70. The springs 52 and 54 bias the front portion 68 and rear portion 70 into abutment so that they are parallel and held in contact when the springs are not flexed. A portion of the chair is shown in FIG. 5 with the back support frame 40 partially reclined, the spring 54 flexed, and the front 68 and rear portions 70 moved relative to one another. As previously discussed, a rear leg reinforcement bar 38 extends between the left rear and right rear legs near their top end. This leg reinforcement bar serves a second purpose, providing a limit to the travel of the back support frame 40. That is, when the back support frame pivots, the underside of the side members 42 and 44, or generally horizontal portion 43, come in contact with the upper side of the leg reinforcement bar 38 at the limit of the seat back travel.

A finger guard 72 is preferably provided to cover the gap between each of the undersides of the side members 42 and 44 and the leg reinforcement bar 38. As shown, the finger guards 72 are held by the bolts 69 adjacent the rearward end of the spring members 52 and 54. Further, the finger guard 72 has downwardly extending shield portions that pass around the leg reinforcement bar 38 in the area where the gap would normally close. Obviously, other protective approaches may also be used. Another advantage of the present invention is that the rear portion of the seat cushion flexes with the seat back avoiding a problem present in the prior art. In some prior art designs, the seat cushion remains stationary but the back support flexes so as to open a gap between the seat cushion and the very lowest portion of the back support. This gap is a potential pinch point. However, no gap is opened in the present device because the seat cushion flexes with the seat back.

As will be clear to those of skill in the art, various alterations may be made to the present invention without departing from its scope or teaching. For example, the flex mechanism may be used with other stackable chair designs as well as with non-stackable chairs. It is the following claims, including all equivalents, that define the present invention.

What is claimed is:

1. A stackable chair comprising;

a base having a pair of generally parallel inverted U-shaped leg members spaced apart so as to define opposite sides of the base, each leg member including a front leg portion, a rear leg portion, and a generally horizontal portion interconnecting the front and rear leg portions, the base further having a generally horizontal seat cushion frame extending between and interconnecting the U-shaped leg members, the seat cushion frame including a transverse front spring reinforcement bar having one end interconnected with one of the leg members and the other end interconnected with the other of the leg members;

a back support frame having a generally vertical portion with an upper and a lower end and a generally horizontal portion extending forwardly from the lower end, the generally horizontal portion including a transverse rear spring reinforcement bar extending side to side and disposed generally parallel to the transverse front spring reinforcement bar;

a spring member having a first end interconnected with the front spring reinforcement bar and a second end interconnected with the rear spring reinforcement bar, the spring member supporting the back support frame such that the back support frame has an unstressed position wherein the generally horizontal portion of the back support frame is generally coplanar with the seat cushion frame and a reclined position wherein the generally vertical portion of the back support frame is moved rearwardly and the generally horizontal portion of the back support frame is moved downwardly, the spring member biasing the back support frame into the unstressed position; and a seat cushion, the seat cushion frame and the generally horizontal portion of the back support frame cooperating to support the seat cushion in a generally horizontal position.

2. The stackable chair according to claim 1, wherein the seat support frame a pair of side members and a front member interconnecting the side members, one of the side members being connected to the generally horizontal portion of each of the leg members, the ends of the transverse front spring reinforcement bar being interconnected with the leg members by being interconnected with the side members of the seat support frame.

3. The stackable chair according to claim 1, further comprising a second spring member having a first end interconnected with the front spring reinforcement bar and a second end interconnected with the rear spring reinforcement bar, each spring member comprising a composite spring.

4. The stackable chair according to claim 3, wherein the spring members are flat springs.

5. The stackable chair according to claim 1, wherein the seat cushion has a front portion and a rear portion, the front portion being attached to the seat cushion support frame and the rear portion being attached to the generally horizontal portion of the back support frame such that when the back support frame is moved between the unstressed and reclined positions, the front and rear portions of the seat cushion move relative to one another.

6. The stackable chair according to claim 1, wherein the seat cushion has a platform member and a compressible portion disposed on the platform member, the platform member being divided into a front portion and a rear portion, the front portion being attached to the seat cushion support frame and the rear portion being attached to the generally horizontal portion of the back support frame such that when the back support frame is moved between the unstressed and reclined positions, the front and rear portions of the platform member move relative to one another.

7. The stackable chair according to claim 1, wherein the base further comprises at least one leg reinforcement bar extending between the pair of inverted U-shaped leg members.

8. The stackable chair according to claim 7, wherein one leg reinforcement bar extends between the rear leg portions of the leg members in a position below the generally horizontal portion of the back support frame such that when the back support frame is in the reclined position, the generally horizontal portion of the back support frame contacts the leg reinforcement bar, whereby the leg reinforcement bar serves as a travel limit for the back support frame.

9. The stackable chair according to claim 8, further comprising a finger guard covering a gap between the generally horizontal portion of the back support frame and the leg reinforcement bar.

10. A stackable chair comprising:

a base having a pair of generally parallel inverted U-shaped leg members spaced apart so as to define opposite sides of the base, each leg member including a front leg portion, a rear leg portion, and a generally horizontal portion interconnecting the front and rear leg portions, the base further having a generally horizontal seat cushion frame extending transversely between the U-shaped leg members and interconnecting the leg members, the seat cushion frame including a first transverse spring reinforcement bar having one end interconnected with one of the leg members and the other end interconnected with the other of the leg members;

a back support frame having a generally vertical portion with an upper and a lower end and a generally horizontal portion extending forwardly from the lower end of the generally vertical portion, the generally horizontal portion including a second transverse spring reinforcement bar extending side to side and disposed generally parallel to the first transverse spring reinforcement bar;

a spring member extending between the first and second transverse spring reinforcement bars and supporting the back support frame adjacent the seat cushion frame, the back support frame having a first position and a second position wherein the generally vertical portion is tilted more rearwardly in the second position than in the first position, the spring member biasing the back support frame to the first position; and a seat cushion supported on the seat cushion frame.

11. The stackable chair according to claim 10, wherein the seat support frame includes a pair of side members and a front member interconnecting the side members, one of the side members being connected to file generally horizontal portion of each of the leg members, the ends of the transverse front spring reinforcement bar being interconnected with the side members of the seat support frame.

12. The stackable chair according claim 10, further comprising a second spring member extending between the front spring reinforcement bar and the rear spring reinforcement bar, each spring member comprising a composite spring.

13. The stackable chair according to claim 12, wherein the spring members are flat springs.

14. The stackable chair according to claim 10, wherein the seat cushion has a front portion and a rear portion, the front portion being attached to the seat cushion support frame and the rear portion being attached to the generally horizontal portion of the back support frame such that when the back support frame is moved between the unstressed and reclined positions, the front and rear portions of the seat cushion move relative to one another.

15. The stackable chair according to claim 10, wherein the seat cushion has a platform member and a compressible portion disposed on the platform member, the platform member being divided into a front portion and a rear portion, the front portion being attached to the seat cushion support frame and the rear portion being attached to the generally horizontal portion of the back support frame such that when the back support frame is moved between the unstressed and reclined positions, the front and rear portions of the platform member move relative to one another.

16. The stackable chair according to claim 10, wherein the base further comprises at least one leg reinforcement bar extending between the pair of inverted U-shaped leg members.

17. The stackable chair according to claim 16, wherein one leg reinforcement bar extends between the rear leg portions of the leg members in a position below the generally horizontal portion of the back support frame such that when the back support frame is in the reclined position, the generally horizontal portion of the back support frame contacts the leg reinforcement bar, whereby the leg reinforcement bar serves as a travel limit for the back support frame.

18. The stackable chair according to claim 17, further comprising a finger guard covering a gap between the generally horizontal portion of the back support frame and the leg reinforcement bar.

19. A stackable chair comprising:

a base having a seat cushion support supported by a plurality of legs, the seat cushion support including a first transverse member, a seat back having a generally vertical portion and a generally horizontal portion, the generally horizontal portion including a second transverse member that is generally parallel to and coextensive with the first transverse member;

a spring member extending between the first and second transverse members and flexibly supporting the seat back in a position adjacent the seat cushion support.

20. The stackable chair according to claim 19, wherein the seat back comprises a pair of spaced apart L-shaped side members, the second transverse member extending between and interconnecting the side members.

21. The stackable chair according to claim 19, further comprising a second spring member extending between the first and second transverse members and cooperating with the first spring member to flexibly support the seat back in a position adjacent the seat cushion support.

22. The stackable chair according to claim 21, wherein the first and second transverse members have outboard ends, the spring members each being positioned adjacent one of the outboard ends.

23. The stackable chair according to claim 19, further comprising a seat cushion having a front portion and a rear portion, the front portion being attached to the seat cushion support and the rear portion being attached to the generally horizontal portion of the seat back such that when the seat back is flexed with respect to the base, the front and rear portions of the seat cushion move relative to one another.

24. The stackable chair according to claim 19, further comprising a seat cushion having a platform member and a compressible portion disposed on the platform member, the platform member being divided into a front portion and a rear portion, the front portion being attached to the seat cushion support and the rear portion being attached to the generally horizontal portion of the seat back such that when the seat back is flexed with respect to the base, the front and rear portions of the platform member move relative to one another.

25. The stackable chair according to claim 19, wherein the spring member is a flat spring formed of a composite material.

* * * * *

UNITED STATES PATENT AND TRADEMARK OFFICE

CERTIFICATE OF CORRECTION

PATENT NO. : 6,471,293 B2
DATED : October 29, 2002
INVENTOR(S) : R. Duane Ware et al.

It is certified that error appears in the above-identified patent and that said Letters Patent is hereby corrected as shown below:

Column 1,
Line 46, after “one” insert -- end --.
Line 46, replace “a” with -- the --.

Column 2,
Line 53, replace “the:seat” with -- the seat --.

Column 3,
Line 10, replace “la” with -- a --.
Line 50, replace “ore” with -- more --.
Line 51, replace “ember” with -- member --.

Column 5,
Line 11, after “frame” insert -- includes --.

Signed and Sealed this

Thirteenth Day of May, 2003

JAMES E. ROGAN
*Director of the United States Patent and Trademark Office*